US006074200A

United States Patent [19]

Bowman et al.

[11] Patent Number: 6,074,200

[45] **Date of Patent: *Jun. 13, 2000**

[54] BURNER APPARATUS HAVING AN AIR DAM AND MIXER TUBE

[75] Inventors: John A. Bowman, Lancaster; Karen R. Benedek; Stephan E. Schmidt, both of Winchester, all of Mass.

[73] Assignee: Gas Research Institute, Chicago, Ill.

[ * ] Notice: This patent issued on a continued prosecution application filed under 37 CFR 1.53(d), and is subject to the twenty year patent term provisions of 35 U.S.C. 154(a)(2).

[21] Appl. No.: 09/009,807

[22] Filed: Jan. 20, 1998

[51] Int. Cl.[7] ..... F23Q 9/00; F23D 14/62

[52] U.S. Cl. ..... 431/278; 431/285; 431/249; 431/350; 431/354; 126/389

[58] Field of Search ..... 431/75, 18, 8, 431/77, 78, 79, 12, 353, 349, 354, 278, 281, 285, 114; 126/344, 374, 350 R, 116 R, 116 A, 361, 389; 236/21 B, 21 R, 14, 95, 96; 137/65, 66; 122/14, 17

[56] References Cited

U.S. PATENT DOCUMENTS

| | | | |
|---|---|---|---|
| 768,753 | 8/1904 | Kaufman | 431/284 |
| 1,933,318 | 10/1933 | Doen | 431/77 |
| 2,781,977 | 2/1957 | Stanley et al. | 236/21 B |
| 3,407,022 | 10/1968 | Andrews et al. | 431/12 |
| 3,656,878 | 4/1972 | Wright | 431/353 |
| 3,894,834 | 7/1975 | Estes | 431/8 |
| 3,988,104 | 10/1976 | Barber | 431/79 |
| 4,041,694 | 8/1977 | Lewis | 431/12 |
| 4,043,742 | 8/1977 | Egan et al. | 431/79 |
| 4,097,223 | 6/1978 | Garnier | 431/353 |
| 4,097,239 | 6/1978 | Patterson | 431/284 |
| 4,161,387 | 7/1979 | Courier de Méré | 431/350 R |
| 4,315,729 | 2/1982 | Tanaka et al. | 431/75 |
| 4,395,226 | 7/1983 | Nakanishi et al. | 431/76 |
| 4,544,348 | 10/1985 | Boij | 431/146 |
| 4,613,300 | 9/1986 | Simpson | 126/116 A |
| 4,627,416 | 12/1986 | Ito et al. | 126/351 |
| 4,777,933 | 10/1988 | Ruark | 126/361 |
| 4,830,601 | 5/1989 | Dahlander et al. | 431/79 |
| 4,872,443 | 10/1989 | Ruark | 126/361 |
| 4,913,647 | 4/1990 | Bonne et al. | 431/79 |
| 4,924,816 | 5/1990 | Moore, Jr. et al. | 122/17 |
| 4,927,351 | 5/1990 | Hagar et al. | 431/12 |
| 5,026,272 | 6/1991 | Takahashi et al. | 431/79 |
| 5,037,291 | 8/1991 | Clark | 431/75 |
| 5,049,063 | 9/1991 | Kishida et al. | 431/79 |
| 5,085,205 | 2/1992 | Hall et al. | 126/350 R |
| 5,139,413 | 8/1992 | Son et al. | 431/354 |
| 5,190,454 | 3/1993 | Murray et al. | 431/12 |

(List continued on next page.)

FOREIGN PATENT DOCUMENTS

| | | |
|---|---|---|
| 0 382 893 B1 | 12/1993 | European Pat. Off. . |
| 0 727 613 A1 | 8/1996 | European Pat. Off. . |

OTHER PUBLICATIONS

G.F. Kirkbright and T.S. West, "The Application of Separated Flames in Analytical Flame Spectroscopy", *Applied Optics*, vol. 7, No. 7, Jul. 1968.

*Primary Examiner*—Ira S. Lazarus
*Assistant Examiner*—Josiah C. Cocks
*Attorney, Agent, or Firm*—Pauley Petersen Kinne & Fejer

[57] ABSTRACT

A pilot burner apparatus for use with gas-fired appliances, such as gas-fired water heaters, is provided with a structure configured for the early detection, and response to, the presence of flammable vapor in the atmosphere ambient to the appliance. Combustion air for the pilot burner is taken from that region of the ambient atmosphere, most likely to become contaminated with flammable vapor first. One or more flame characteristics of the pilot burner flame are monitored, and if the flame characteristics depart from a predetermined range of parameters, gas flow to the pilot and main burner(s) of the appliance are cut off. The sensitivity of the pilot burner is such that flammable vapors are detected before the concentration of flammable vapors car rise to the lower flammability limit of the anticipated flammable vapor (s).

4 Claims, 7 Drawing Sheets

U.S. PATENT DOCUMENTS

| | | | |
|---|---|---|---|
| 5,317,992 | 6/1994 | Joyce | 126/389 |
| 5,368,474 | 11/1994 | Welden | 431/349 |
| 5,511,516 | 4/1996 | Moore, Jr. et al. | 122/17 |
| 5,667,375 | 9/1997 | Sebastiani | 431/75 |
| 5,791,298 | 8/1998 | Rodgers | 126/361 |
| 5,797,355 | 8/1998 | Bourke et al. | 126/350 R |
| 5,797,358 | 8/1998 | Brandt et al. | 431/22 |
| 5,848,586 | 12/1998 | Garms | 126/361 |
| 5,918,591 | 7/1999 | Vollmar et al. | 126/361 |

BURNER APPARATUS HAVING AN AIR DAM AND MIXER TUBE

BACKGROUND OF THE INVENTION

1. The Technical Field

The present invention relates to gaseous fuel-fired burners such as may be used for gas-fired appliances, for example residential gas-fired water heaters.

2. The Prior Art

Safety issues are important considerations in the design, manufacture and operation of gaseous fuel-fired burners, such as are found in gas-fired appliances. This is especially true for appliances operated in a residential environment. Such appliances include residential gas-fired water heaters, gas-fired clothes dryers, furnaces, etc.

One such safety issue involves the potential danger which arises when such burners become exposed to flammable vapors in the ambient atmosphere external to the appliance. Such flammable vapors can cause uncontrolled propagation of flames and/or possible explosions.

An object of the invention is to be able to provide a burner for a gas-fired appliance, capable of detecting and responding to the presence of undesired flammable vapors in the vicinity of the burner. The goal would be to turn down and/or completely shut off of the burner, to prevent undesired propagation of flame and/or explosion.

Another object of the present invention is to provide a flammable vapor sensing burner which has a high degree of sensitivity so that even very low concentrations of flammable vapor can be detected and responded to.

Still another object of the present invention is to provide a burner having a simplified construction with attendant low cost, long life expectancy and enhanced durability of construction and reliability of operation.

These and other objects of the invention will become apparent in light of the present specification (including claims) and drawings.

SUMMARY OF THE INVENTION

The present invention comprises, in part, a pilot burner apparatus, for use in association with a main burner for a gas-fired appliance, for sensing flammable vapor present in the atmosphere ambient to such a gas-fired appliance.

A first fuel gas transporting member is connectable to a source of fuel gas. The source of fuel gas may be configured for providing fuel gas, through a second fuel gas transporting member, to a main burner of a gas-fired appliance.

At least one mixer member may be provided for mixing fuel gas received by the first fuel gas transporting member, with air taken from atmosphere external and ambient to the appliance, which air may contain flammable vapor. A fuel gas-air transporting member may be operably connected to the means for mixing fuel gas. The fuel gas-air transporting member preferably is configured for receiving the mixed fuel gas and air which may contain flammable vapor, and transporting the mixed fuel gas and air to a combustion chamber within the appliance.

A primary pilot flame holder may be operably positionable within the combustion chamber of a gas-fired appliance, the primary pilot flame holder being operably connected to the fuel gas-air transporting member.

At least one secondary air shield member is operably associated with the primary pilot flame holder, for substantially precluding access of secondary air which may be present within the combustion chamber of a gas-fired appliance, to a flame held by the primary pilot flame holder.

Operably associated with the at least one secondary air shield member, are means for facilitating ignition of a main burner of a gas-fired appliance.

At least one sensor is provided for detecting a change in a characteristic of a primary pilot flame held by the primary pilot flame holder, such change resulting from the presence of, or change in the amount of, flammable vapor in the air from the atmosphere ambient to the gas-fired appliance.

The at least one sensor for detecting a change in a characteristic of a flame is sufficiently sensitive to detect a change corresponding to preselected relative amount of flammable vapor present in the air from the atmosphere ambient to the gas-fired appliance.

A controller may be operably associated with the at least one sensor for detecting a change in a characteristic of a flame, for controlling the operation of the source of fuel gas for a gas-fired appliance, in response to the presence of, or change in the amount of, flammable vapor in the air from the atmosphere ambient to the gas-fired appliance, for halting the supply of fuel gas to the appliance, when the at least one, sensor for detecting a change in a characteristic of a flame, detects a change corresponding to a predetermined amount of flammable vapor in the air ambient to the appliance.

In a preferred embodiment of the invention, the at least one mixer member for mixing fuel gas received from the first fuel gas transporting member, with air taken from atmosphere external and ambient to the appliance, which air may contain flammable vapor, comprises a mixer tube disposed substantially adjacent to, but spaced apart from an outlet of the first fuel gas transporting member, an inlet of the mixer tube being positioned to receive a jet of fuel gas from the gas nozzle. The outlet of the first fuel gas transporting member and the mixer tube are preferably operably positionable substantially external to a gas-fired appliance, so that air from the atmosphere ambient to a gas-fired appliance will become entrained with the jet of fuel gas from the outlet of the first fuel gas transporting member, and transported into the inlet of the mixer tube.

The at least one secondary air shield member may comprise a secondary air shield, operably positioned substantially about the primary pilot flame holder, so as to substantially preclude access by secondary air within the combustion chamber of an appliance, to a pilot flame held by the primary pilot flame holder, so that any such flame is substantially unaffected by any such secondary air.

The at least one sensor for detecting a change in a characteristic of a flame held by the primary pilot flame holder may comprise a thermocouple operably disposed proximate to the primary pilot flame holder for sensing the temperature in the immediate vicinity of the primary flame holder, and for providing a signal representative of the temperature which has been sensed.

In one embodiment of the invention, the controller for controlling the operation of the source of fuel, in response to the presence of flammable vapor in the air ambient to the gas-fired appliance may comprise a gas valve connected directly to the thermocouple, so that upon cooling of the thermocouple, the gas valve closes.

In an alternative embodiment of the invention, the controller for controlling the operation of the source of fuel, in response to the presence of flammable vapor in the air ambient to the gas-fired appliance may comprise means for comparing the signal representative of the temperature in the immediate vicinity of the primary pilot flame holder, operably associable with the source of fuel gas. The means for comparing the signal representative of the temperature in the immediate vicinity of the primary flame holder may be operably configured to compare the signal is provided by the thermocouple to a predetermined range of values representative of acceptable conditions for the flame held by the primary pilot flame holder; and means for causing the source of fuel gas to cease providing fuel gas to the main burner and pilot burner when the signal provided by the thermocouple departs from the predetermined range of values representative of acceptable conditions for the flame held by the primary pilot flame holder.

In an alternative embodiment of the invention, the controller for controlling the operation of the source of fuel, in response to the presence of flammable vapor in the air ambient to the gas-fired appliance may further comprise means for determining the rate of change over time of the temperature in the immediate vicinity of the primary flame holder. Means may be provided for comparing the determined rate of change over time of the temperature to a preselected value for the rate of change over time of the temperature. Means may also be provided for causing the source of fuel gas to cease providing fuel gas to the main burner and pilot burner when the rate of change over time of the temperature is both negative and exceeds a predetermined absolute value.

In a preferred embodiment of the invention, the at least one secondary air shield member is a vertically oriented, substantially hollow cylindrical member, having a primary pilot flame holder disposed at a lower end thereof, and a substantially open upper end opposite the lower end, the at least one secondary air shield member being positionable proximate a main burner flame holder of a gas-fired appliance. The means, operably associated with the at least one secondary air shield member, for facilitating ignition of a main burner of a gas-fired appliance comprises a secondary pilot flame holder surface, operably disposed about the substantially open upper end of the substantially hollow cylindrical member, for establishing a secondary pilot flame, for igniting fuel gas migrating from a main burner flame holder, toward establishing a main burner flame.

In an alternative preferred embodiment of the invention, the at least one secondary air shield member is a horizontally oriented, substantially hollow cylindrical member, having a primary pilot flame holder disposed at one end thereof, and a substantially closed end opposite the one end, the at least one secondary air shield member being positionable proximate a main burner flame holder of a gas-fired appliance. The means, operably associated with the at least one secondary air shield member, for facilitating ignition of a main burner of a gas-fired appliance comprises a secondary pilot flame holder aperture, operably disposed in an upwardly facing region of a cylindrical side portion of the substantially hollow cylindrical member, for igniting fuel gas migrating from a main burner flame holder, toward establishing a main burner flame.

In still another embodiment of the invention, the at least one secondary air shield member is a substantially hollow, cylindrical member, having a primary pilot flame holder positioned at one end thereof, the at least one secondary air shield member being positionable proximate a main burner flame holder of a gas-fired appliance. The means, operably associated with the at least one secondary air shield member, for facilitating ignition of a main burner of a gas-fired appliance comprises at least one flash tube member, operably associated with the substantially hollow cylindrical member, for receiving fuel gas from a main burner flame holder, and conducting said fuel gas toward a primary pilot flame held by the primary pilot flame holder, toward igniting the fuel gas from the main burner flame holder, and, in turn, establishing a main burner flame.

The invention, also comprises, in part, a method for sensing flammable vapor present in the atmosphere ambient to such a gas-fired appliance, and for controlling the operation of a gas-fired appliance in response to the presence of such flammable vapor, the method comprising the steps of:

connecting a first fuel gas transporting member, to a source of fuel gas, the source of fuel gas being configured for providing fuel gas, through a second fuel gas transporting member, to a main burner of a gas-fired appliance;

mixing fuel gas received by the first fuel gas transporting member, with at least one mixer member, with air taken from atmosphere external and ambient to the appliance, which air may contain flammable vapor;

transporting the mixed fuel gas and air to a combustion chamber within the appliance with a fuel gas-air transporting member;

connecting a primary pilot flame holder operably positionable within the combustion chamber of a gas-fired appliance, with the fuel gas-air transporting member;

substantially precluding access of secondary air which may be present within the combustion chamber of a gas-fired appliance, to a flame held by the primary pilot flame holder, with at least one secondary air shield member;

detecting, with at least one sensor, a change in a characteristic of a flame held by the primary pilot flame holder, such change resulting from the presence of, or change in the amount of, flammable vapor in the air from the atmosphere ambient to the gas-fired appliance, the change corresponding to preselected relative amount of flammable vapor present in the air from the atmosphere ambient to the gas-fired appliance; and controlling, with a controller, the operation of the source of fuel gas for a gas-fired appliance, in response to the presence of, or change in the amount of, flammable vapor in the air from the atmosphere ambient to the gas-fired appliance, and halting the supply of fuel gas to the appliance, when the at least one sensor detects a change corresponding to a predetermined amount of flammable vapor in the air ambient to the appliance.

The step of mixing fuel gas received by the first fuel gas transporting member, with at least one mixer member, with air taken from atmosphere external and ambient to the appliance, which air may contain flammable vapor, further comprises the steps of:

disposing a mixer tube substantially adjacent to, but spaced apart from an outlet of the first fuel gas transporting member, an inlet of the mixer tube being positioned to receive a jet of fuel gas from the gas nozzle, positioning the outlet of the first fuel gas transporting member and the mixer tube substantially external to a gas-fired appliance, so that air from the atmosphere ambient to a gas-fired appliance will become entrained with the jet of fuel gas from the outlet of the first fuel gas transporting member, and transported into the inlet of the mixer tube.

The step of substantially precluding access of secondary air which may be present within the combustion chamber of a gas-fired appliance, to a flame held by the primary pilot flame holder, with at least one secondary air shield member, further comprises the step of:

operably positioning a secondary air shield substantially about the primary pilot flame holder, so as to substantially preclude access by secondary air within the combustion chamber of an appliance, to a pilot flame held by the primary pilot flame holder, so that any such flame is substantially unaffected by any such secondary air.

The step of detecting a change in a characteristic of a flame held by the primary pilot flame holder, with at least one sensor, further comprises the step of:

disposing a thermocouple proximate to the primary pilot flame holder for sensing the temperature in the immediate vicinity of the primary pilot flame holder, and for providing a signal representative of the temperature of the immediate vicinity of the primary pilot flame holder.

The step of controlling, with a controller, the operation of the source of fuel, in response to the presence of flammable vapor in the air ambient to the gas-fired appliance further comprises the steps of:

connecting the thermocouple directly to a gas valve, so that upon cooling of the thermocouple, the gas valve closes.

In an alternative embodiment of the invention, the step of controlling, with a controller, the operation of the source of fuel, in response to the presence of flammable vapor in the air ambient to the gas-fired appliance further comprises the steps of:

comparing the signal representative of the temperature of the immediate vicinity of the primary pilot flame holder, operably associable with the source of fuel gas, by comparing the signal provided by the thermocouple to a predetermined range of values representative of acceptable conditions for the flame held by the primary pilot flame holder; and causing the source of fuel gas to cease providing fuel gas to the main burner and pilot burner when the signal provided by the thermocouple departs from the predetermined range of values representative of acceptable conditions for the flame held by the primary pilot flame holder.

The step of controlling the operation of the source of fuel, in response to the presence of flammable vapor in the air ambient to the gas-fired appliance further comprises the steps of:

determining the rate of change over time of the temperature in the immediate vicinity of the primary flame holder;

comparing the determined rate of change over time of the temperature to a preselected value for the rate of change over time of the temperature;

causing the source of fuel gas to cease providing fuel gas to the main burner and pilot burner when the rate of change over time of the temperature is both negative and exceeds a predetermined absolute value.

BEST MODE FOR CARRYING OUT THE INVENTION

Figure 1:
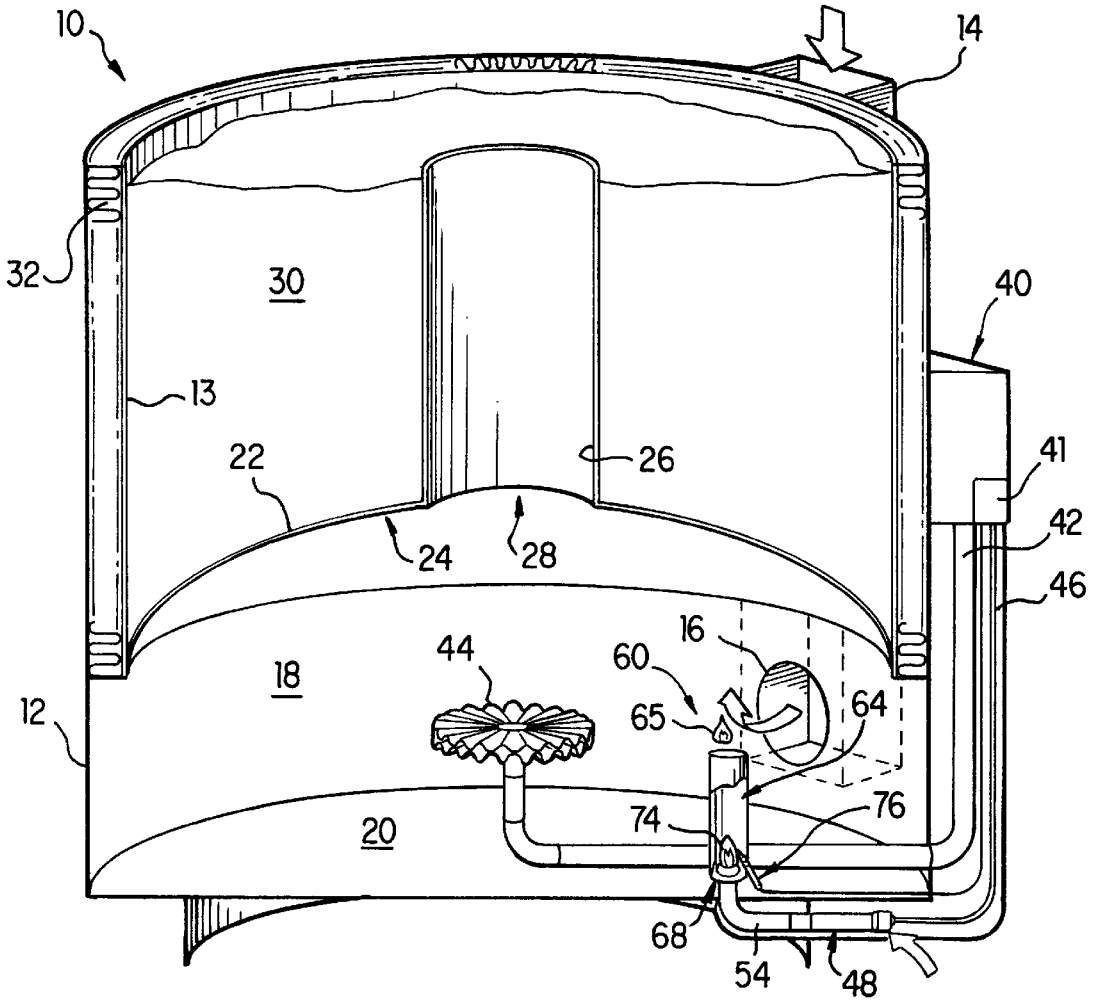
FIG. 1 is a fragmentary sectional schematic illustration, in section, of a flammable vapor sensing pilot burner apparatus configured in accordance with the principles of the present invention, in the environment of a burner for a gas-fired water heater.

While this invention is susceptible of embodiment in many different forms, there are shown in the drawings and will be described herein in detail, one embodiment with the understanding that the present disclosure is intended to be considered as an exemplification of the principles of the invention and is not intended to limit the invention to the embodiment illustrated.

Concentrations of flammable vapor in air, well below a flammable vapor's Lower Flammability Limit (LFL), alter the designed air-to-fuel ratio of any partially or fully pre-mixed gas burner. Alterations in the air-to-fuel ratio of a pre-mixed burner affect several flame characteristics. These flame characteristics include: flame position relative to the burner (including partial or complete flame lift-off); flame shape; flame temperature; and flame ionization level. These pre-mixed burner flame characteristics can be sensed by a number of methods. These methods may include the use of: thermocouple(s) to sense temperature or to sense flame position and shape; flame ionization detectors to sense the degree of flame ionization; photodiodes to sense flame position and shape; and/or ultra-violet sensors to sense flame temperature and/or degree of ionization. A change in any one of the above-identified flame characteristics can be correlated to a change in the air-to-fuel ratio for a premixed burner resulting from the presence of flammable vapor in the ambient air. If through such correlation it is detected that the air-to-fuel ratio has changed beyond the range of normal operation variation for the particular installation, then gas flow may be completely shut off to the gas-fired appliance. Prompt shutting off the gas flow, if done before the flammable vapors reach their lower flammability limit, will usually, it is believed, prevent ignition of the flammable vapor by the burner(s) of the gas-fired appliance.

Figure 2:
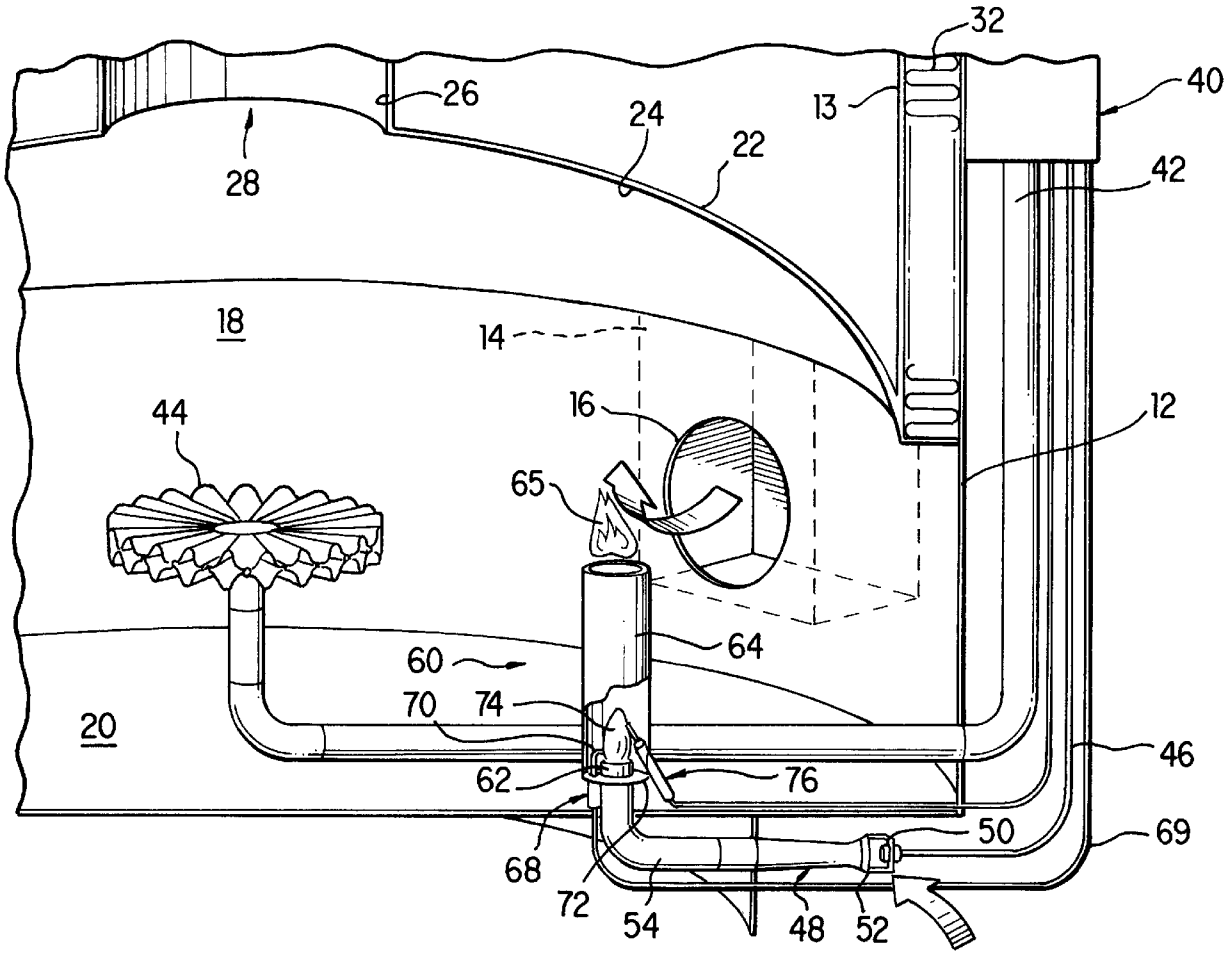
FIG. 2 is an enlarged fragmentary sectional schematic view of the apparatus of FIG. 1.

The pilot burner apparatus 60 shown in FIGS. 1 and 2 replaces the diffusion flame pilot burner typically found in a gas-fired water heater. Pilot burner apparatus 60 includes a partially pre-mixed pilot burner which senses and responds to small changes in air-to-fuel ratios as a result of the presence of flammable vapor in the ambient air surrounding the appliance. The apparatus also performs the functions of a traditional pilot in that it heats a thermocouple to energize a gas safety valve and ignites the main burner.

A partially pre-mixed pilot burner is an important element of the pilot burner apparatus and process of the present invention. To effectively employ the apparatus and process of the present invention, the air flow to the pre-mixed pilot burner must be well managed. The primary air intake of the pre-mixed pilot burner must be exposed, to the air source which may potentially contain flammable vapor. However, to achieve sensitivity to low flammable vapor levels, the actual flame of the pre-mixed pilot burner must be shielded from any air source.

FIGS. 1 and 2 illustrate, somewhat schematically, a burner, in section, employing a pilot burner apparatus in accordance with the present invention, such as may be used in a residential gas-fired appliance such as a water heater.

Appliance 10 (FIG. 1), e.g. a water heater, includes a shell 12, on the outside of which is air duct 14 which has an opening 16 in the side of shell 12 which permits ambient air to be conducted into combustion chamber 18. The construction of shell 12, as illustrated, is simplified, for purposes of this application. Typically, the shell will have a reinforced supporting bottom structure, for enabling the shell to take the load of the weight of the water. Combustion chamber 18 is defined in part by the vertical walls of shell 12, the bottom pan 20, and insert 22 which forms an upwardly convex wall 24 and a central cylindrical tube 26 providing passage 28. In the embodiment of a water heater, shell 12 also forms in part the walls of the water heater, and the region above insert 22, identified by reference numeral 30 (FIG. 1)—which is the region in which the water to be heated is contained. Tube 26 will, preferably, extend completely through to the top of shell 12 (not shown) to provide the chimney for escape of combustion products exiting combustion chamber 18. In the region of shell 12 above the periphery of insert 22, an inner wall 13 preferably will be provided with insulation 32 (e.g., fiberglass batt) positioned in between.

Air duct 14 may be formed as a generally rectangular structure, with an opening to ambient air at its top. Preferably, the duct 14 will be long enough so that its opening will be elevated above floor level sufficiently so that most volatile vapors which may be encountered (e.g., in a basement, such as paint thinner fumes, etc.) will be delayed in rising high enough to enter into air duct 14. In that way, the combustion air which is being supplied directly from ambient to combustion chamber 18 will not, in ordinary circumstances, be contaminated with flammable vapors, as may the air which is entrained in the pilot fuel/air flow, as described in further detail herein.

Gas valve 40 is preferably mounted on the outside of shell 12 and is connected to a supply of gaseous fuel (not shown) in a conventional manner. Gas valve 40 itself may be of otherwise known configuration, apart from modifications as described herein in order to enable gas valve 40 to be actuated in accordance with the principles of the present invention.

Gas tube 42 is connected to gas valve 40 and extends into combustion chamber 18. Flame holder 44 is supported atop the end of gas tube 42 to act as the flame holder for the main burner of appliance 10. Pilot gas tube 46 directs gaseous fuel to mixer tube 48, which preferably has a venturi configuration, for expansion of the mixed gases. As can be seen in enhanced detail in FIG. 2, the end of pilot gas tube 46 terminates in a nozzle 50 which is spaced apart from the inlet 52 to mixer tube 48. The mixer tube inlet 52 and pilot gas tube nozzle 50 are positioned external to shell 12 and external and removed from the entrance to air duct 14, so as to be exposed to the ambient atmosphere immediately outside of and preferably near the bottom of apparatus 10, most preferably, as close to the floor as possible. The positioning of the connection between nozzle 50 and inlet 52 should be considered since, with the exception of certain gases such as hydrogen, methane and ethane, most combustible gases which are likely to be found in a residential environment (especially, for example, in a basement) are substantially heavier than the gases which make up the ambient atmosphere and so will tend to gravitate toward the lowest point in the occupied space, e.g., the floor.

Mixer tube 48 connects to pilot gas tube 54 which extends into combustion chamber 18 and supports pilot burner apparatus 60. Although mixer tube 48 and pilot gas tube 54 are shown as two separate components, it is also contemplated that a unitary structure may be employed. Pilot burner apparatus 60 comprises primary flame holder 62, which is a perforated plate type of flame holder, and secondary air shield 64. Piezo-igniter electrode 68, which may be of otherwise conventional configuration, may be supported adjacent primary flame holder 62, such that tip 70 (FIG. 2) is physically close to primary flame holder 62. For example, piezo-igniter electrode 68 may be supported on a flange 72 (FIG. 2) surrounding primary flame holder 62. Alternatively, electrode 68 may be positioned next to the outlet of secondary air shield 64. Flame holder 62 preferably is a cylindrical perforated disk which is positioned in the end of shield 64, perpendicular to the axis of shield 64 and occupying the complete inner diameter of the inlet end of the air shield 64.

Typically, ignition of pilot burner 60 is accomplished by supplying a desired amount of gaseous fuel through tube 46 and ultimately out through primary flame holder 62 as a fuel/air mixture. Combustion air, from the ambient air surrounding the appliance, mixes with the jet of fuel exiting nozzle 50 and is entrained with the fuel jet and enters inlet 52 of tube 48. The mixed fuel gas and combustion air exits pilot gas tube 54, at primary flame holder 62. An electrical potential is then applied to piezo-igniter electrode 68, via wire 69 (FIG. 2) until a spark jumps from tip 70 to the surface of primary flame holder 62, igniting the gases and creating flame 74 (FIG. 2). Thermocouple 76 preferably is likewise supported on flange 72 so that the tip 78 (FIG. 2) of thermocouple 76 is also in contact with or extends into flame 74.

A second flame body 65 will form at the upper end of secondary air shield 64, as shown in FIG. 2, and described in further detail hereinafter.

Once flame 74 has been established in pilot burner apparatus 60, to a satisfactory extent, gas valve 40 will supply fuel gas to flame holder 44 via tube 42. After a sufficient amount of combustible gas has occupied the space surrounding flame holder 44, the flame 65 will propagate and ignite the gases surrounding flame holder 44. In a preferred embodiment of the invention, main flame holder 44 may be a conventional flame holder, such as are found in conventional gas-fired water heaters.

Figure 3:
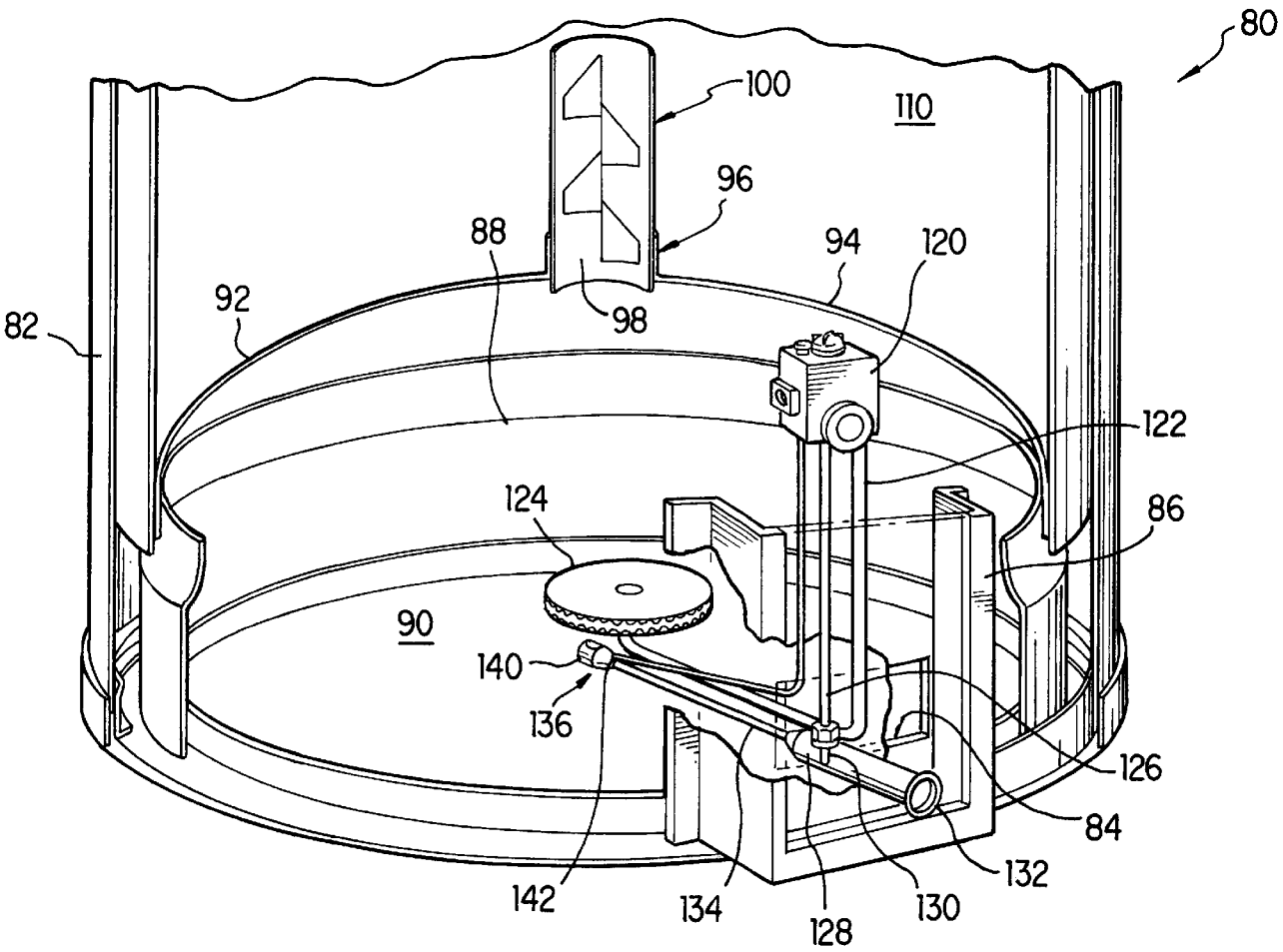
FIG. 3 is an enlarged fragmentary sectional schematic view of an alternative preferred embodiment of the apparatus of the present invention.

FIG. 3 illustrates an alternative preferred embodiment of the apparatus of the present invention. Appliance 80, e.g. a water heater, includes a shell 82, through which air opening 84 extends, surrounded by air dam 86, which permits ambient air to be conducted into combustion chamber 88. Air dam 86 (shown partially in fragment, to show the components behind it) preferably is, like the prior embodiments, configured as a rectangular chute, with an opening at its top, to ambient air, so that ambient air from some height above the floor, descends the passage of the air dam, to get in to combustion chamber 88. Combustion chamber 88 is defined in part by the vertical walls of shell 82, the bottom pan 90, and insert 92 which forms an upwardly convex wall 94 and a central cylindrical tube 96 providing passage 98. Tube 96 typically will be connected to a chimney 100, providing both escape of combustion products, as well as a location for heat exchange with the surrounding water reservoir. In the embodiment of a water heater, shell 82 also forms in part the walls of the water heater, and the region above insert 92, identified by reference numeral 110—which is the region in which the water to be heated is contained.

Gas valve 120 is preferably mounted on the outside of shell 82 and is connected to a supply of gaseous fuel (not shown) in a conventional manner. Gas valve 120 itself may be of otherwise known configuration, apart from modifications as described herein in order to enable gas valve 120 to be actuated in accordance with the principles of the present invention.

Gas tube 122 is connected to gas valve 120 and extends into combustion chamber 88. Flame holder 124 is supported atop the end of gas tube 122 to act as the flame holder for the main burner of appliance 80. Pilot gas tube 126 directs gaseous fuel to mixer tube 128, which preferably has a venturi configuration, for expansion of the mixed gases. The end of pilot gas tube 126 terminates in a nozzle 130 which projects into mixer tube 128. Mixer tube 128 has, at its outer end, an opening 132 in the face of air dam 86. The orifice of nozzle 130 will point upstream (i.e., along pipe 134, toward secondary air shield 140). Accordingly, the jet of fuel gas causes ambient air to be pulled into opening 132, and entrained into the fuel jet.

The positioning of opening 130 is important, since, with the exception of certain gases such as hydrogen, methane and ethane, most combustible gases which are likely to be found in a residential environment (especially, for example, in a basement) are substantially heavier than the gases which make up the ambient atmosphere and so will tend to gravitate toward the lowest point in the occupied space, e.g., the floor. In an alternative configuration, opening 130 may be placed in the bottom wall of air dam 86.

Mixer tube 128 connects to pilot gas tube 134 which extends into combustion chamber 88 and supports pilot burner apparatus 136, including secondary air shield 140. Although mixer tube 128 and pilot gas tube 134 are shown as two separate components, it is also contemplated that a unitary structure may be employed. Pilot burner apparatus 136 comprises a primary flame holder (not shown in FIG. 3), which is preferably a perforated plate type of flame holder. The primary flame holder will preferably be a disc-shaped flame holder as previously described. However, instead of being mounted facing upward, the flame holder will mounted around a horizontal axis, inside the secondary air shield. A thermocouple 142 extends into secondary air shield 140, for sensing the presence, temperature and/or other condition of a flame within air shield 140, in a manner substantially the same as described with respect to the embodiment of FIGS. 1 and 2. Secondary air shield 140 is a horizontally extending cylinder, having one end connected to tube 134, and having the opposite end closed. A round aperture 144 is positioned in the side of secondary air shield 140, facing upward, to permit the exit of unburned fuel gas, combustion byproducts, and flame.

Aside from the specific structural differences described and illustrated, the pilot burner apparatus of FIG. 3 is configured and operates in substantially the same manner as the pilot burner apparatus of FIGS. 1 and 2.

Figure 5:
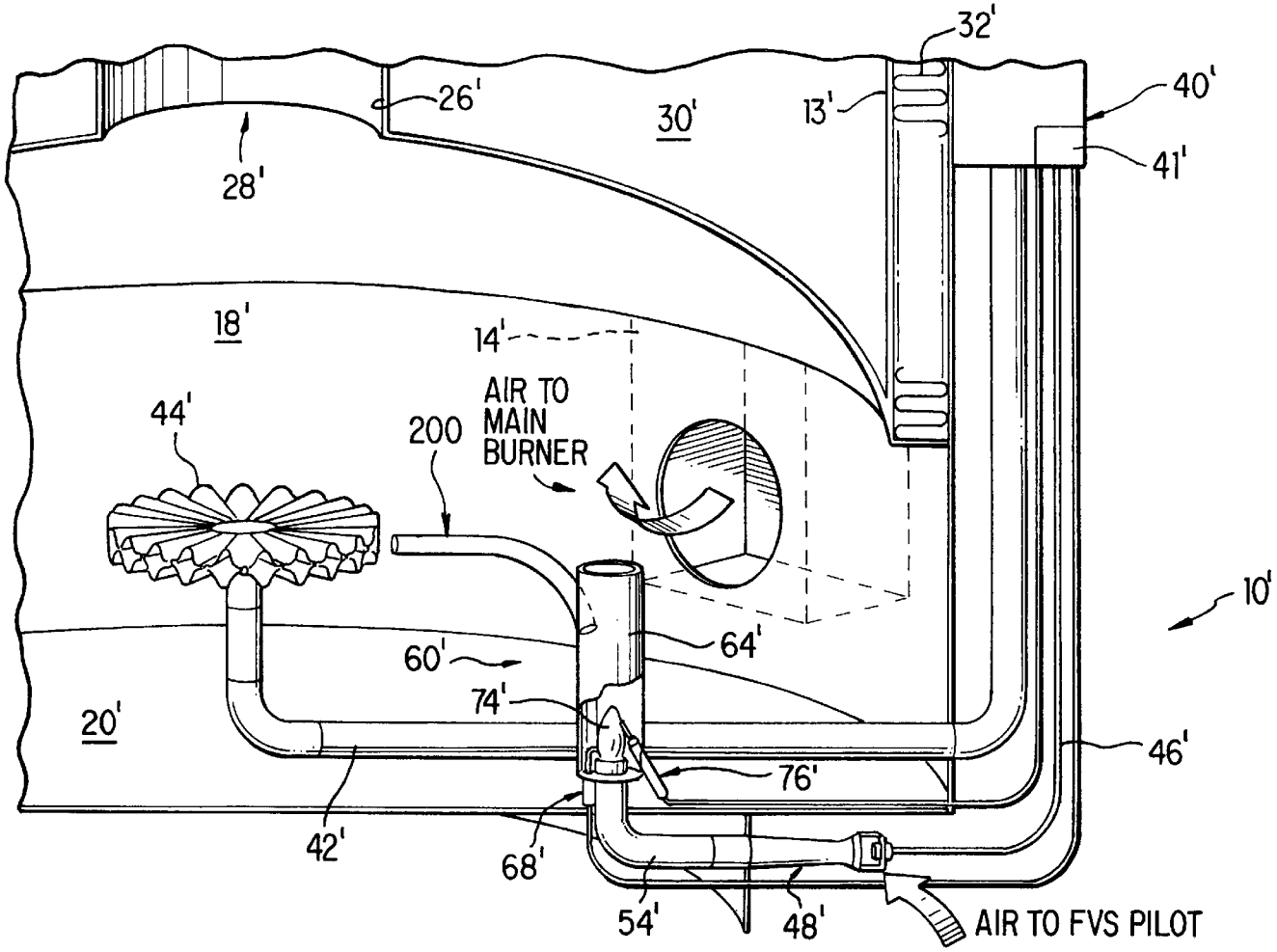
FIG. 5 is an enlarged sectional fragmentary schematic view of a flammable vapor sensing pilot burner apparatus according to another alternative embodiment of the invention.

FIG. 5 is an enlarged sectional fragmentary schematic view of a flammable vapor sensing pilot burner apparatus according to a further alternative preferred embodiment of the invention. The apparatus of FIG. 5 is substantially similar to the configuration of the embodiment of FIGS. 1 and 2, and accordingly, elements having similar structures and functions as the apparatus of FIGS. 1 and 2 are provided with a prime (').

The apparatus of FIG. 5 is provided with a flash tube 200, extending from secondary air shield 64' toward main flame holder 44'. Flash tube 200 ignites the main flame at flame holder 44', like flash tubes in conventional pilot burner configurations. That is, as fuel gas exits the main burner flame holder, some fuel gas is directed into and travels down the flash tube, where it is ignited by the primary pilot flame. Then, the flame flashes up the tube to the main burner flame holder.

Apart from certain specific structural details of the several embodiments, the basic operating principles of the flammable vapor sensing pilot burners of the several embodiments are the same, relative to the vapor sensing and control functions.

The pre-mixed pilot burners employed in the present invention utilize secondary air shields (e.g., secondary air shield 64) to ensure that the primary pilot flame are not exposed to a secondary air source. The geometry of the secondary air shields and that of the primary pilot flame holders (e.g., primary flame holder 62 and flange 72) are optimized together to achieve a balance between flammable vapor sensitivity and pilot flame stability.

The size, shape and configuration of the primary flame holder and the secondary air shield, in each of the embodiments, have been selected with the goal of providing a stable pre-mixed flame with an equivalence ratio $\phi$ (ratio of fuel/air actual to fuel/air stoichiometric) of approximately 1.3 under normal operating conditions. The value for the equivalence ratio $\phi$ was selected for two reasons: 1) it is believed to be more difficult to entrain sufficient primary air to operate an atmospheric, pre-mixed burner leaner or nearer to stoichiometric; and 2) the upper flammability limit for natural gas is approximately at $\phi$ equal to 1.7, and operating closer to this limit is believed to promote the tendency toward flame lift off.

Although several flame characteristics, as described previously, can be correlated to an air-to-fuel-ratio indicative of the presence of flammable vapor, the system of the present invention, uses one or more thermocouples to sense changes in the flame's position, shape and temperature. Using thermocouple(s) for sensing flammable vapor makes the system self-powered and compatible with existing gas safety valves.

In a simplest form of the invention, the thermocouple's millivolt output may be connected directly to the gas valve solenoid. After the pilot flame has been started, such as by an operator holding down the typically provided start button (which typically literally pushes the valve solenoid to an open position) and igniting the gas, the thermocouple begins producing an output voltage, which holds the solenoid open against its spring force. If the pilot flame lifts off, the thermocouple cools, the voltage drops until the solenoid spring force cannot be overcome, and the valve closes, cutting off all gas flow to both pilot and main burners.

In conjunction with this operation, air ducts or air dams are provided, with elevated openings to ambient air. These elevated openings for the air for the main burners, provide a "delay", in that flammable vapors will be sensed by the pilot first, and before the flammable vapors can rise to the level of the opening of the duct or dam, the sensing action of the pilot will have had time to take place, leading to the shut off of the gas.

In an alternative preferred embodiment, the thermocouple may be connected in series to a control unit (e.g., control unit 41 of FIG. 1), which may be a microprocessor or similar device, suitably configured to monitor the voltage output of the thermocouple, and compare such voltage values, over time, to data stored in the control unit which correspond to voltage values representative of desired, or at least nominal satisfactory function of the burner. The control unit will be suitably associated with the gas valve for the appliance, so that the control unit may condition the voltage output of the thermocouple, to accelerate the process of closing the gas valve, once the control unit has determined that flammable vapor conditions exist. That is, the thermocouple output voltage may still be high enough to otherwise hold the gas valve open, but if the voltage changes reflect lift off or imminent lift off of the primary pilot flame, the control unit will cut off or clip the output voltage, so that the gas valve closes immediately.

If the air ambient to the appliance, which is being inletted as combustion air at the pilot air inlet (e.g., 52), contains flammable vapor, the characteristics of the primary pilot flame situated above the primary pilot flame holder will change, and the flame will become unstable. Ultimately, as the level of flammable vapor increases, the primary pilot flame will eventually lift off of the primary pilot flame holder and move to the top (or upper opening) of the secondary air shield (the embodiments of FIGS. 1–3) so that the primary and secondary pilot flames will become superimposed. The operation of the embodiment of FIG. 5 is slightly different, due to the presence of the flash tube. When flash tube 200 is present, a secondary pilot flame may or may not be stabilized at the top of secondary air shield 64'. The pilot burner may include a primary pilot flame holder (not shown) which may be substantially the same as in the embodiments of FIGS. 1–3. However, in the embodiment of FIG. 5, when the flammable vapor content of the ambient air exceeds the designed upper limit, then the primary pilot flame will simply lift off and move up to the end of the secondary air shield.

Figure 4:
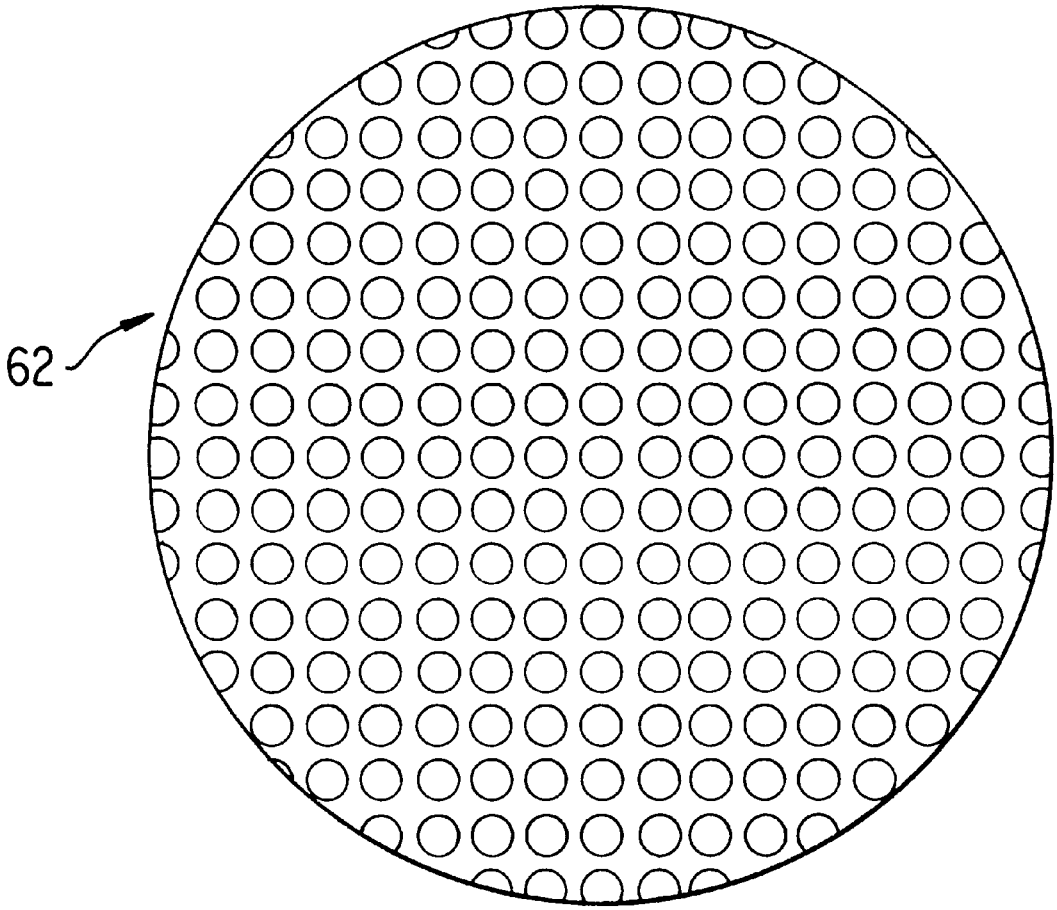
FIG. 4 is an enlarged fragmentary plan view of a portion of a primary flame holder according to a preferred embodiment of the invention.

To control the value of $\phi$ at which the primary pilot flame lifts off and to ensure the overall performance of the flammable vapor sensing system of the present invention, several design parameters for the primary flame holder (each embodiment) should be considered. These design parameters include: 1) flame holder port size; 2) the number of ports or flame holder surface open area; 3) the port pattern; and 4) flame holder thickness. FIG. 4 is an enlarged fragmentary plan view of a portion of a primary flame holder according to the preferred embodiments of the invention. Although flame holder 62 is shown and discussed, it is to be understood that the following discussion applies equally to the flame holders of all the embodiments of the invention. Certain minor variations in design, readily obtainable by one of ordinary skill in the art having the present disclosure before them, may be necessary and appropriate when moving from one embodiment to the next, depending upon the specific appliance application.

As shown in FIG. 4, the primary flame holder (62) preferably is a simple flat cylindrical perforated disk. The port size of the primary flame holder should be limited to prevent flash back through the primary flame holder. The major characteristic dimension (diameter or slot width) of a port should be less than 0.030", generally. Further, for loadings as described, port diameters >0.030" to 0.040" are believed to be prone to flashback. Port density or open area in the primary flame holder is set to achieve burner port loadings in the range of 3,000 to 6,000 Btu/hr/in$^2$. For a firing rate of 500 Btu/hr, the open area of the primary flame holder ranges from 0.0833 in$^2$ to 0.1666 in$^2$. Higher port loadings make the primary flame holder more sensitive to increases in $\phi$ above the nominal set point of 1.3. Therefore, higher port loadings make the flammable vapor sensing pilot burner system of the present invention sensitive to lower concentrations of flammable vapor. Conversely, higher port loadings also make the primary pilot flame less stable under normal operating conditions.

The thickness of the primary flame holder can influence the lift off point for a given port loading. A thicker primary flame holder will tend to be less stable under normal operating conditions. Preferably, the primary flame holder thickness will be in the range of 0.02"–0.05".

In a preferred embodiment of the invention, the primary flame holder will have a uniform 44% open area pattern with 0.03" diameter holes and a port loading of 3300 BTUH/in$^2$. The other dimensions of a preferred primary flame holder will be as indicated in FIG. 4. Preferably, a uniform rectangular pattern of circular perforation is used for the ports.

The secondary air shield, in each embodiment, is preferably a cylinder, at least in its external configuration. The following characteristics of the secondary air shield require consideration: the inner diameter; the taper of the inner diameter; the length of the secondary air shield; and the exit orientation of unburnt gases and combustion products. For the firing rates and port loadings previously described, inner diameters of approximately 0.75" and 1.0" were tested. It is believed that a 1.0" diameter is preferable, in that it is believed that a 0.75" diameter, increases the instability of the flame under most conditions and may make ignition of the primary pilot flame very difficult.

Tapering the inner diameter from 1.0" at the base, does not substantially affect acceleration of lift off once the onset of lift off occurs, which is a desirable trait. Reducing the inner diameter of the secondary air shield 64 near the plane at which unburnt gases and combustion products exit the secondary air shield promotes formation of secondary pilot flame 65. This secondary pilot flame ignites the main burner flame. This secondary pilot flame also serves to burn out the unburnt gases exiting the primary pilot flame 74 and provides visual confirmation that the pilot has been successfully lit.

The length of the secondary air shield was varied from 1.0" to 3.0" to examine the effect upon stability, lift off, and ignition of the primary pilot flame 74, and the stability and ignition of the secondary pilot flame. A preferred length of the secondary air shield 64 is believed to be approximately 1.0". Increasing the length, appears to decrease the stability and ignition reliability of the secondary pilot flame. The ignition reliability of the secondary pilot flame appears to depend primarily on the temperature of the unburnt gases exiting the secondary air shield 64 being above the autoignition temperature of the gases in standard air. Increasing the length of the secondary air shield 64 increases the area for the unburnt gases to transfer heat to the ambient, thereby decreasing the temperature of the unburnt gases.

The secondary air shield may be provided with either axial (vertical pilots—FIGS. 1, 2, 5 and 6) or radial (horizontal pilots—FIGS. 3 and 7) exit orientations for the unburnt gases and combustion products.

Figure 6:
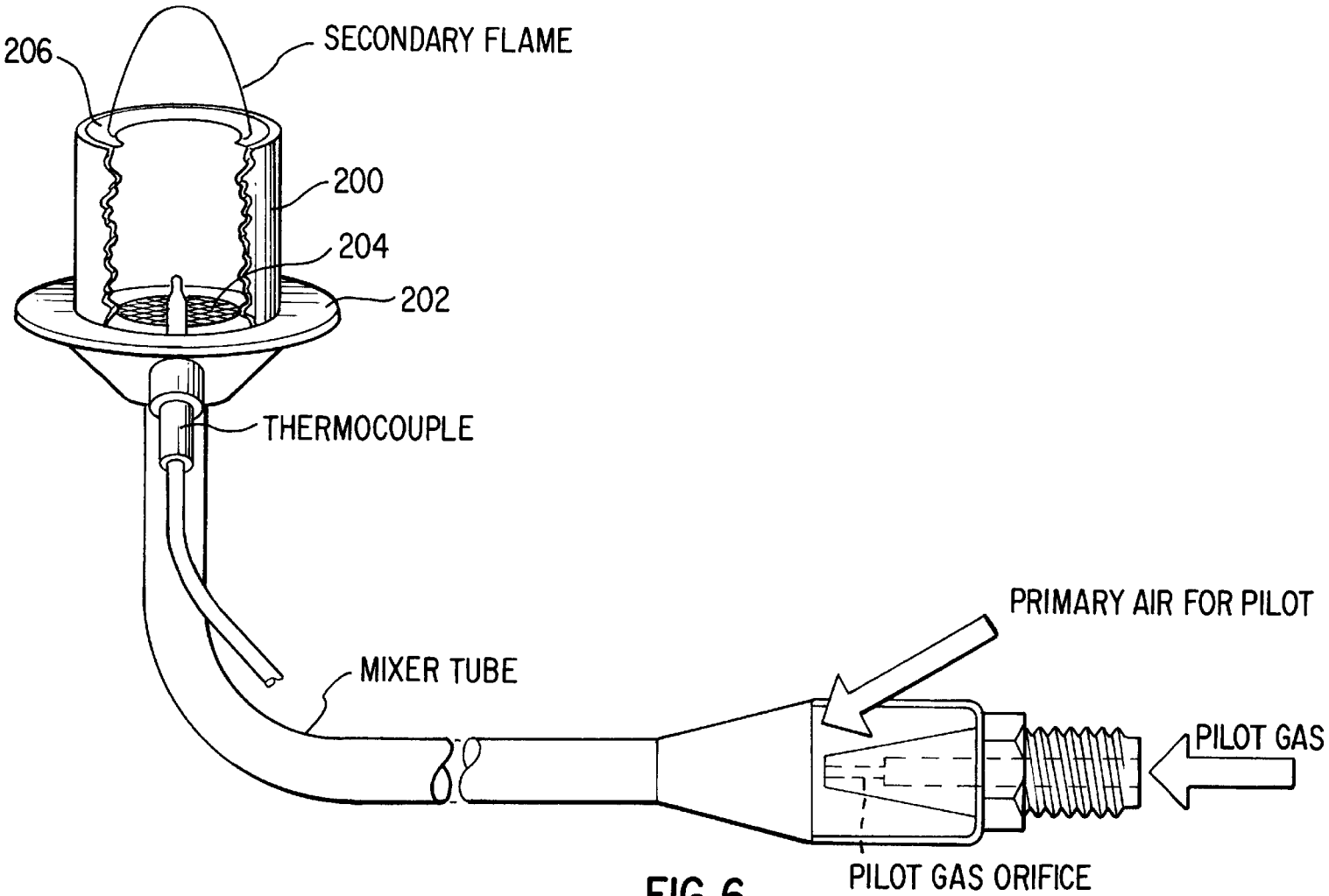
FIG. 6 is an enlarged illustration of a pilot burner having a vertically oriented secondary air shield.

FIG. 6 is an enlarged illustration of a pilot burner configuration in which the secondary air shield has a vertical orientation, such as may be employed in the embodiments of FIGS. 1, 2, and 5. The pilot burner shown in FIG. 6 is substantially identical to that shown in FIGS. 1 and 2, and may be supplied with premixed air and fuel gas by components which are the same as those shown in FIGS. 1 and 2. A typical secondary air shield will have a cylindrical body 200, resting upon a flange 202 which surrounds a primary pilot flame holder 204, which may have the construction as discussed elsewhere herein. The upper end of the cylindrical body 200 may be provided with an opening which, as discussed, is smaller in diameter than the interior of the cylindrical body. This may be accomplished by providing a radially inwardly projecting lip 206. This lip may also be concave and/or conical. Such a construction may aid in providing a location for the secondary pilot flame to stabilize. In the vertical orientation, the upper end of the secondary air shield is open. A vertical orientation facilitates mounting of the pilot unit through the bottom pan of an appliance such as a water heater.

Figure 7:
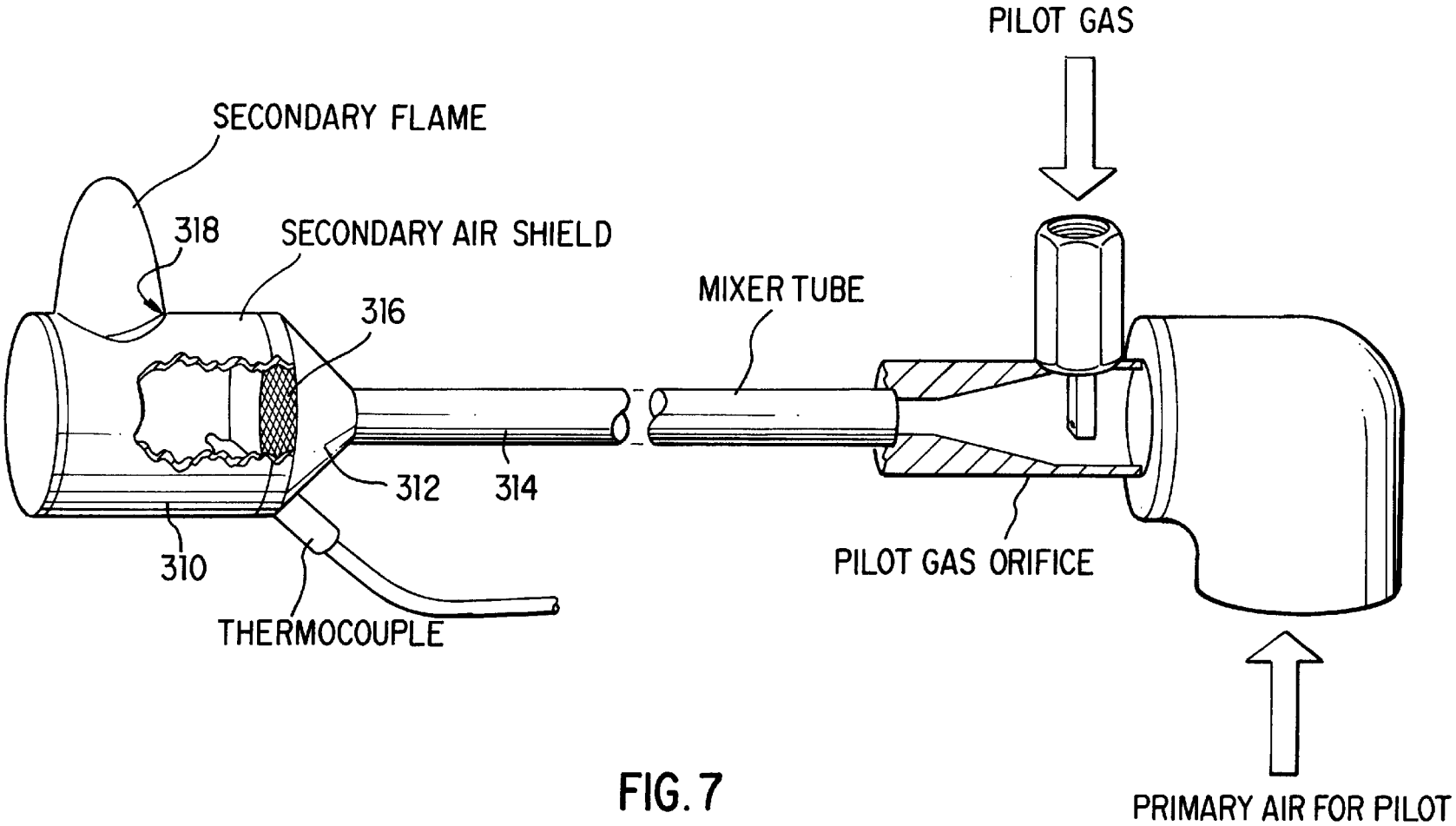
FIG. 7 is an enlarged illustration of a pilot burner having a horizontally oriented secondary air shield.

FIG. 7 illustrates a pilot burner having a horizontally oriented secondary flame holder. The supply of fuel gas and primary air may be accomplished in a manner similar to that described with respect to FIG. 3. A typical secondary air shield will have a cylindrical body 310, extending from a conical fitting 312 connected to a mixer tube 314. The secondary air shield 310 will surround a primary pilot flame holder 316, which may have the construction as discussed elsewhere herein. The far end of the cylindrical body 310 will be closed. An opening 318 will be placed in the side of the cylindrical body 310, to provide a location for the secondary pilot flame. A horizontal orientation facilitates mounting of the pilot unit in existing water heater designs, with minimal alteration of the existing design construction.

In the horizontal (radial exit) orientation, the unburnt gases exit radially from the secondary air shield. Typically, a hole of diameter approximately equal to the exit diameter of a, secondary air shield constructed for vertical (axial) orientation is drilled into the side of the secondary air shield. The radial exit orientation permits mounting a pilot horizontally and adjacent to the main burner fuel gas transporting member, which is a manner similar to the manner in which a conventional pilot is installed in a conventional water heater. The horizontal, lateral exit configuration may be preferred in some applications as being easier to fit into existing appliance (e.g., water heater) designs.

In a still further alternative embodiment (not shown), a horizontal, axial, secondary air shield configuration may be provided, similar to that of FIG. 1 but simply tipped over 90°. Alternatively, an axial-type secondary air shield may be provided, in which the longitudinal axis of the air shield is tilted at some angle to the vertical, between 0° and 90°.

Additional design considerations, readily apparent to one of ordinary skill in the art, having the present disclosure before them, such as issues of dealing with water condensation in the combustion chamber during operation, may require slight modification of the secondary air shield, depending upon the particular appliance application. Such modifications may include the placement of a shield at the top of a vertically oriented secondary air shield (to deflect falling condensate) or the provision of a drainage hole (in the lower portion of a horizontally oriented air shield (to prevent pooling or collection of condensate). Such measures may be taken in order to prevent quenching of the pilot flame(s) by the condensed material.

As the level of a flammable vapor present in the air ambient to the appliance increases, the air-to-fuel ratio of the pre-mixed pilot burner decreases. This decrease causes a decrease in the flame temperature and a decrease in the burning velocity of the flame. Burning velocity of a flame is the rate at which a flame progresses into a fuel mixture relative to the speed of the fuel mixture exiting the openings in the flame holder. The decrease in burning velocity is a fundamental cause for the change in flame position and shape.

As a result of the decrease in flame temperature and the changes in flame position and shape, the output from the thermocouple(s) in the pre-mixed pilot burner decreases. Furthermore, the output from the thermocouple(s) also decreases as the level of flammable vapor increases. Well before the lower flammability level of a flammable vapor is reached, the thermocouple output decays to a level too low to energize the gas safety valve, typically less than two millivolts for a typical thermocouple.

For example, if the flame velocity of the primary pilot flame decreases sufficiently, for example, due to a substantial increase in the presence of flammable vapors in the ambient air, the primary pilot flame will lift off completely from primary pilot flame holder. In the absence of the primary pilot flame, the thermocouple will cool rapidly and, in turn, its voltage output will drop rapidly. The thermocouple output may be used as the driving voltage of a solenoid in the gas valve to keep the gas valve open. If the thermocouple voltage drops below a preselected absolute value, the amount of voltage required to keep the solenoid open, it will close and the gas flow will stop.

This primary pilot flame lift off phenomenon will occur in each embodiment of the invention, regardless of whether a secondary pilot flame is stabilized. In the embodiments where a secondary pilot flame is stabilized, the primary pilot flame forms inside the secondary air shield, and a secondary pilot flame will form at the exit to the secondary air shield, and upon lift off, the primary pilot flame will move to the top of the secondary air shield, and the secondary flame will expand and move upward enough to accommodate the primary flame, and to permit diffusion of air around its periphery, to maintain both flames.

The control of a gas valve solenoid may be accomplished in another manner. The cooling of the thermocouple over time is a non-linear function. The slope of the curve of temperature versus time is initially steep, then flattens out. The signal of the thermocouple may be fed into a suitably programmed microprocessor or similar control device, and the voltage values monitored over time. If the rate of change of temperature over time is noted to have a large, negative value, which would correspond to rapid cooling, then shut down of the gas flow may be ordered, quickly after lift off of the primary pilot flame, without having to wait for the thermocouple to actually cool down to a particular temperature. The steep negative slope of the temperature/time curve will indicate cooling from flame lift off before the thermocouple will have had time to cool down to an actual temperature which would be conclusive evidence of lift off. It is desirable to detect and respond to primary pilot flame lift off as quickly as possible.

A preferred configuration of the pre-mixed pilot burner and thermocouple system is to arrange the primary flame aeration, flame holder, secondary air shield, such that at a flammable vapor concentration of 30% to 50% by volume, of the butane LFL (0.54% to 0.9% by volume butane in air), there is a sharp decrease in the flame's burning velocity. The change of the flame's burning velocity causes the flame to completely lift-off from the pre-mixed pilot burner's flame holder and extinguish itself. With the pilot flame extinguished, the output from the thermocouple(s) decreases quickly. This configuration significantly improves the speed of response for the pre-mixed pilot burner and thermocouple system.

It should be noted that the particular constructions of the primary pilot air supply, pilot fuel gas supply, pilot gas orifice, etc. (all being upstream of the mixer tube) in each of the embodiments of FIGS. 6 and 7 are functionally interchangeable, and vary only to accommodate the structural requirements of particular installations, and may be so varied readily by one of ordinary skill in the art having the present disclosure before them.

The foregoing description and drawings merely explain and illustrate the invention and the invention is not limited thereto except insofar as the appended claims are so limited, as those skilled in the art having the disclosure before them will be able to make modifications and variations therein without departing from the scope of the invention.

We claim:

1. In a pilot burner apparatus wherein a fuel gas supply furnishes a fuel gas to a main burner, a shell forms a combustion chamber, and the main burner is mounted within the combustion chamber, the improvement comprising:

an air dam, the air dam having a first opening at a top portion of the air dam, the first opening in communication with the combustion chamber and with an atmosphere surrounding the shell;

a mixer tube having one end in communication with a flame holder of a pilot burner apparatus and an opposite end extending through a second opening in the air dam, the opposite end in communication with the atmosphere at a location below the first opening of the air dam, and a gas tube in communication with the fuel gas supply and the mixer tube.

2. In the pilot burner apparatus according to claim 1 further comprising an insert attached to a bottom pan defining the combustion chamber.

3. In the pilot burner apparatus according to claim 1 wherein the open top of the air dam is at an elevation higher than the the opposite end of the mixer tube.

4. In the pilot burner apparatus according to claim 1 wherein the air dam is sealably attached to the shell.

* * * * *